United States Patent [19]

Ackerman

[11] Patent Number: 5,012,530

[45] Date of Patent: May 7, 1991

[54] DIMPLE FORMING NECKTIE AND METHOD OF MAKING THE SAME

[76] Inventor: Myron H. Ackerman, 7209 Promenade Dr., Apartment D-201, Boca Raton, Fla. 33433

[21] Appl. No.: 476,753

[22] Filed: Feb. 8, 1990

[51] Int. Cl.[5] ..... A41D 25/00; A41D 25/16

[52] U.S. Cl. ..... 2/144; 2/146

[58] Field of Search ..... 2/144, 145, 146, 147, 2/148, 149, 150, 152 R, 153

[56] References Cited

U.S. PATENT DOCUMENTS

| | | | |
|---|---|---|---|
| 1,511,793 | 10/1924 | Worms | 2/144 |
| 1,702,544 | 2/1929 | Milne | 2/146 |
| 1,712,098 | 5/1929 | Webb . | |
| 2,178,893 | 11/1939 | McCurrach | 2/146 |
| 2,184,737 | 12/1939 | Fallar | 2/146 |
| 2,195,373 | 3/1940 | Snyder et al. | 2/148 |
| 2,311,460 | 2/1943 | Naftali | 2/146 |
| 2,409,744 | 10/1946 | Edmonson . | |
| 2,416,839 | 3/1947 | Mulhauser | 2/146 |
| 2,484,182 | 10/1949 | Newman . | |
| 2,653,325 | 9/1953 | McCarthy . | |
| 2,653,525 | 9/1953 | McCarthy | 2/146 |
| 2,669,724 | 2/1954 | Jarrett | 2/153 |
| 2,679,050 | 5/1954 | Dzus | 2/146 |
| 3,744,057 | 7/1973 | Luceri | 2/146 |
| 3,747,123 | 7/1973 | Miller | 2/146 |
| 4,123,802 | 11/1978 | Ackerman . | |
| 4,506,389 | 3/1985 | Franklin | 2/144 |

FOREIGN PATENT DOCUMENTS

| | | | |
|---|---|---|---|
| 474335 | 6/1951 | Canada | 2/144 |
| 561991 | 8/1958 | Canada | 2/146 |
| 1091336 | 4/1955 | France | 2/146 |
| 506302 | 5/1939 | United Kingdom | 2/146 |

*Primary Examiner*—Werner H. Schroeder
*Assistant Examiner*—Jeanette E. Chapman
*Attorney, Agent, or Firm*—Kenyon & Kenyon

[57] ABSTRACT

A necktie including an outer casing and facing. The outer casing has a large end, a small end, a neckband portion and an intermediate knot forming portion. The facing has longitudinal sides and a central portion therebetween. Laterally spaced ears extend from the longitudinal sides and fold back toward the central portion. Each ear includes an end distal to its respective longitudinal side. These distal ends remain spaced from one another to form a valley therebetween. The facing is sewn to the back side of the outer casing such that the ears are in the vicinity of the knot forming portion. When a knot is placed in the knot forming portion, the ears cause a dimple to be formed in the outer casing immediately below the knot.

18 Claims, 1 Drawing Sheet

DIMPLE FORMING NECKTIE AND METHOD OF MAKING THE SAME

FIELD OF THE INVENTION

The present invention relates to neckties generally, and more particularly to neckties having a "dimple" inducing construction.

BACKGROUND OF THE INVENTION

Typically, neckties comprise an outer casing, tipping and an interliner therebetween to give the tie support and weight. The tipping, or alternatively, the pocket or facing, is a piece of material sewn to the back of the tie casing, either on the wide end of the tie or the narrow end thereof, or at both ends. This is done to give the tie a more luxurious appearance. Generally, facing material has at least 80 threads per inch in the warp and at least 50 threads per inch in the filling.

It is desirable to have a necktie construction that permits the necktie to acquire an appearance that will exhibit the luster and pattern of the textile fabric constituting the outer casing of the necktie when in the tied condition. This is especially true with a necktie of the four-in-hand type. To this end, it is desirable to provide a necktie that, when tied or knotted in the usual manner, will develop a tear-shaped concavity, commonly known as a "dimple," immediately below the knot, and located substantially midway between the marginal edges of the necktie. In addition to producing a necktie construction which, when tied, will result in imparting a contour to the small areas or portions of the necktie about the "dimple", it is desirable to provide a tie construction that, when tied, resists the natural tendency of the knot to loosen.

Various attempts have been made to attain the foregoing features For example, in U.S. Pat. No. 2,409,744, two elongated strips of stiffening material, such as felt or any fabric having a frictional surface, are positioned on the back face of the knot tying portion of the tie. These strips extend outwardly from the point where the neck encircling portion joins the knot tying portion. They also extend toward the end of the knot tying portion a sufficient distance so that when a suitable knot is tied, the outer ends of the frictional strips will extend below the knot. This tie construction induces "dimple" formation once a knot is made in the tie and tends to resist the natural tendency of the knot to loosen. However, the strips are, for example, secured in position by stitching, or they may be formed by coating or impregnating those portions of the knot forming part of the tie. Thus, providing the tie with such strips involves additional manufacturing steps. Additionally, the strips must provide stiffening lines having a frictional surface. Therefore, these strips can detract from the "hand" of the tie. Further, in the final pressing of the tie during manufacture, the strips can press through the front or back (or both) of the tie.

A further tie construction which has been used to obtain a dimple effect when a knot is placed in the tie is disclosed in U.S. Pat. No. 2,653,325. This tie includes a reinforcing lining which is placed within the outer casing of the tie. A centrally located, longitudinally extending depression or cavity, is preformed in the reinforcing lining, with the depression disposed in offset relation to the planes defining the thickness of the lining. In this way, the lining ensures formation of a "dimple" in the necktie immediately adjacent the knot and approximately midway between the marginal edges of the tie. However, the depression must be formed in the interliner. This can be done in a number of ways. For example, the portion of the liner to be preformed to define the depressed portion can be impregnated with a thermosetting resinous material or the like and the impregnated portion of the liner put in a mold and subjected to heat and pressure. Accordingly, numerous manufacturing steps are required. Further, the resultant depressed portion is relatively stiff, and thus can detract from the overall crease resistance of the tie. In addition, the relatively stiff depressed portion also detracts from the "hand" of the tie. Further, in the final pressing of the tie during manufacture, the relatively stiff depressed portions can press through the front or back (or both) of the tie.

In recent years, necktie outer casings have been made of lighter materials. This has resulted in-part from the demand for lighter apparel. The above-described problems associated with relatively stiff material, used to induce "dimple" formation, are exacerbated in ties having outer casings made of lighter material. In addition, when stiffening strips are used and adhesively attached to the inner surface of the outer casing the adhesive can bleed through the relatively lightweight outer casing and show up as shadows in the outer casing along the stiffening strips.

Therefore, there is a need to provide a necktie which ensures obtaining a dimpled effect when the necktie is in a knotted condition without detracting from the "hand" of the tie. This necktie also should minimize or prevent knot slippage. In addition, there is a need to provide such a necktie which is of simple construction to increase manufacturing efficiencies.

Furthermore, ties having outer casings made of lighter materials have been provided with heavier interliners or double interliners to provide these ties with sufficient support. However, this approach has detracted from the overall desired lightness of the tie. Accordingly, there is a need to reduce the weight of the necktie without sacrificing the requisite support for its casing.

SUMMARY OF THE INVENTION

The present invention is directed to a necktie that avoids the problems and disadvantages of the prior art. The present invention accomplishes this goal in a necktie including an outer casing and secondary fabric. The outer casing includes a first end, a second end and an intermediate knot forming portion therebetween. The secondary fabric includes longitudinal marginal edges and a central portion therebetween. Laterally spaced ears extend from the longitudinal marginal edges and fold back toward the central portion. Each ear includes an end distal to its respective longitudinal marginal edge These distal ends remain spaced from one another. The secondary fabric is sewn to the back side of the outer casing such that the ears are in the vicinity of the knot forming portion.

When a knot is placed in the knot forming portion of the tie, the ears cause a "dimple" to be formed in the outer casing immediately below the knot. Although the ears provide sufficient firmness to induce "dimple" formation and resist knot slippage, they are relatively supple, and thus do not detract from the "hand" of the tie. The ears also add body to the knot and prevent it from collapsing at its sides. Further, the ears can be formed when the secondary fabric is cut to optimize manufacturing efficiencies.

Another feature of the present invention is the secondary fabric length. This fabric is elongated and extends into the knot forming portion of the tie. As a result of the unique length of the secondary fabric, an air cushion is formed between the secondary fabric and the interliner and between the secondary fabric and the outer casing. This air cushion adds to the total wrinkle and crease resistance of the tie. Further, facing material is used to make the secondary fabric. Thus, the secondary fabric, having a length as described above, permits the use of a lighter and less expensive interliner, thereby resulting in a lighter weight tie with enough bulk at the knot and sufficient body elsewhere. This is due to the fact that interliner fabric is substantially heavier than facing fabric. Particularly, although interliner fabric has substantially fewer threads per inch than facing fabric, interliner yarns are about five times heavier than facing yarns.

The ears also are symmetrically positioned about the longitudinal axis of the tie. Accordingly, when the tie is arranged about a shirt collar in a conventional manner, the knot remains centered, relative to the points of the collar.

The above is a brief description of some deficiencies in the prior art and advantages of the present invention. Other features, advantages and embodiments will be apparent to those skilled in the art from the following description, accompanying drawings and appended claims.

BRIEF DESCRIPTION OF THE DRAWINGS

FIG. 4 is a sectional view taken along lines 4—4 of FIG. 3 wherein FIG. 4*a* illustrates one embodiment and FIG. 4*b* illustrates a further embodiment of the present invention.

DETAILED DESCRIPTION

Figure 1:
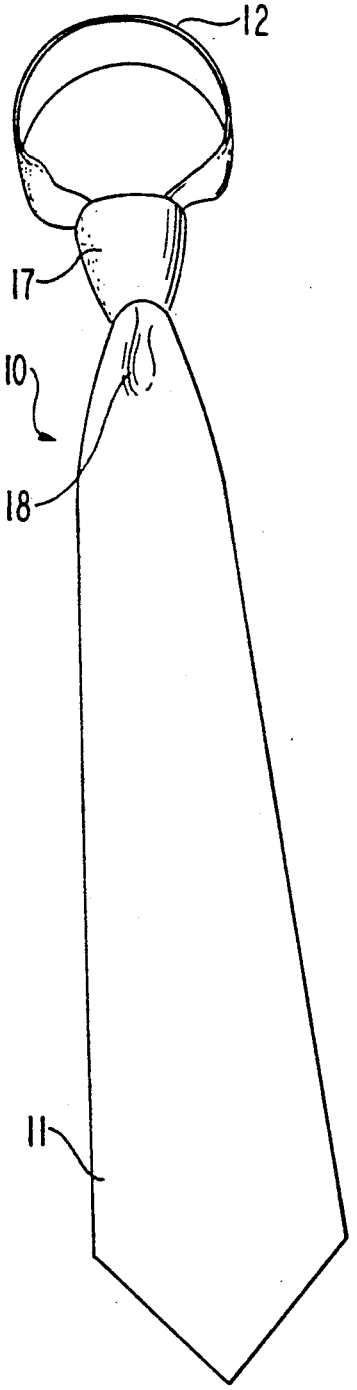
FIG. 1 is a front elevational view of a necktie in accordance with the principles of the present invention.

Referring to the drawings in detail wherein like numerals indicate like elements, FIG. I shows a necktie in accordance with the principles of the present invention. Necktie 10 includes a conventional wide end portion 11 which is exposed exterially when the necktie is in the tied condition. The necktie also includes neckband portion 12 interconnecting wide end portion II and a conventional narrow end portion (not shown), at the end opposite wide end portion 11.

Figure 2:
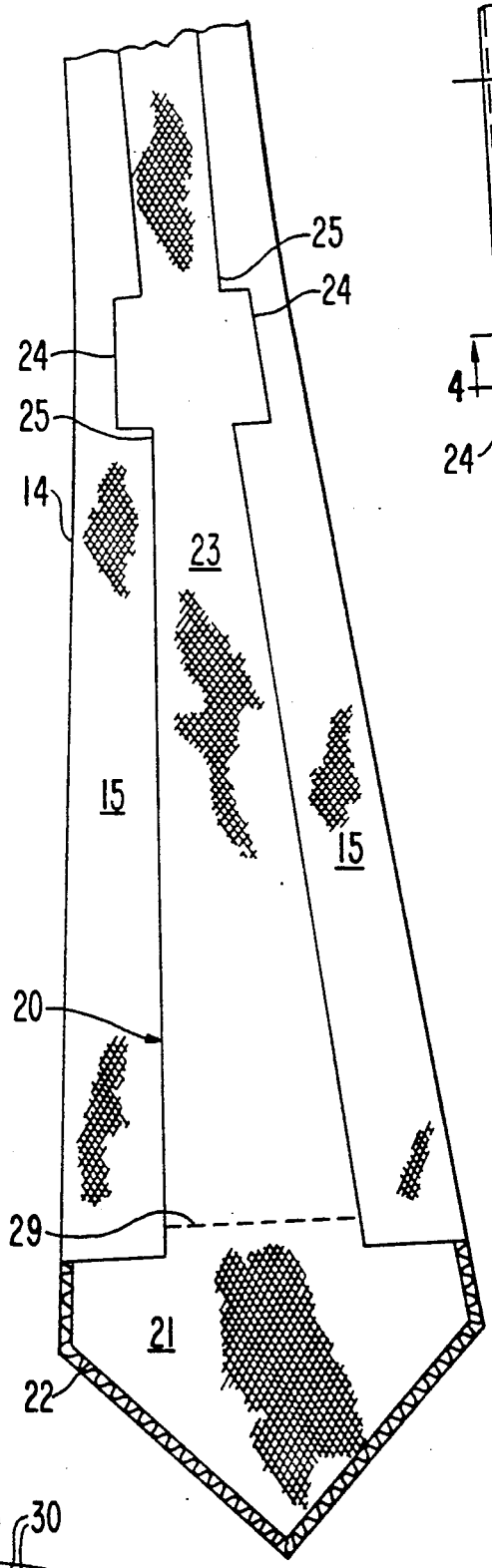
FIG. 2 is a top plan view of the tie illustrated in FIG. 1 opened to show the elongated facing.
Figure 3:
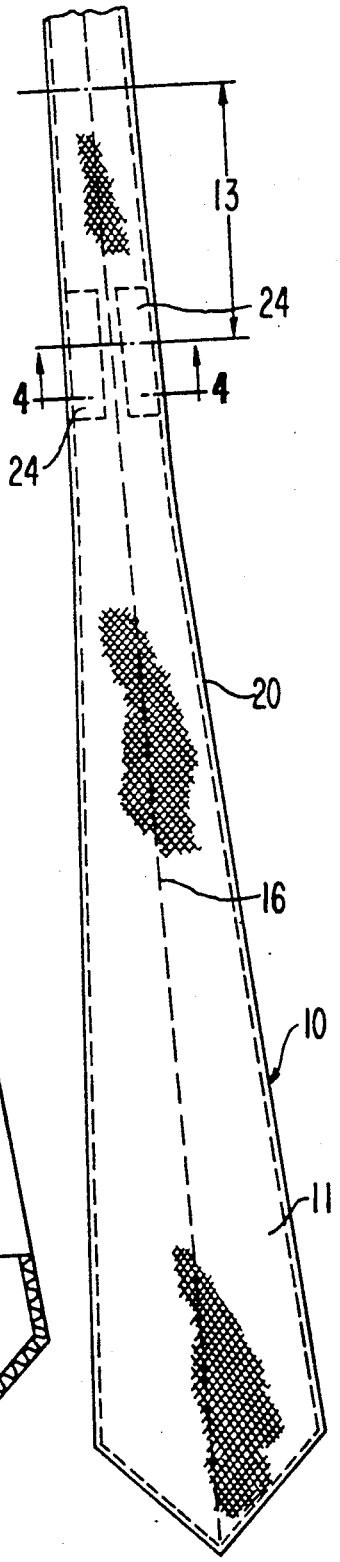
FIG. 3 is a bottom plan view of the necktie illustrated in FIG. 1 showing the elongated facing in phantom.
Figure 4:
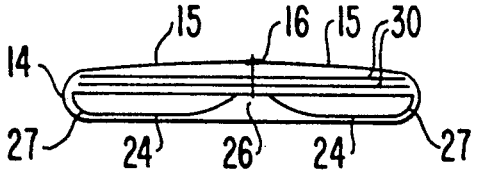

Referring to FIG. 2, the interior of the necktie is shown in an open state. More particularly, the interior of the tie is shown before side portions 15 of outer casing 14 are folded inwardly and stitched together as illustrated in FIGS. 3 and 4. Returning to FIG. 2, elongated facing 20 extends along the inside of outer casing 14. Elongated facing 20 includes bottom portion 21 and elongated portion 23. Bottom portion 21 essentially extends along the entire width of the wide end of the outer casing and is stitched thereto as designated by stitching 22. Elongated portion 23 extends along the central portion of casing 14 and into knot tying portion 13 of tie 10 and is held in place by the pressed folds of the finished tie. Knot tying portion 13 begins about 24 inches from the large end of the tie and is about 5 inches in length. It should be understood that elongated facing 20 can extend beyond knot tying portion 13, e.g., elongated facing 20 can extend the full length of the tie.

Elongated facing 20 also includes laterally spaced ears 24 which extend from longitudinal marginal edges 25 of elongated portion 23 of facing 20. Accordingly, ears 24, which are about 3 inches in length, can be formed while cutting the facing from the desired material during manufacture. As evident from the drawings, ears 24 taper in width as the width of the tie narrows. These ears also extend a sufficient distance into knot forming portion 13 to ensure "dimple" formation when neck size varies or when different types of knots, such as basic four-in-hand, one-half Windsor and Windsor knots, are made in knot forming portion 13. Ears 24 are folded back upon elongated facing 20 and secured thereto by, for example, stitching or adhesive that remains supple after curing. The ends of ears 24 distal to longitudinal marginal edges 25 remain spaced by about ¼ inch to form valley 26 (FIG. 4). In this way, the ears provide the portion just beneath knot tying portion 13 with a firm region adjacent the marginal sides of the tie without adding unnecessary stiffness thereto.

Referring to FIG. 4, interliner 30, illustrated as a double layer interliner, is positioned inside outer casing 14 to add support and crease resistance to the tie. Outer casing 14 surrounds the interliner and elongated facing 20 and forms an enclosure therefor via center stitching 16. Stitching 16 secures side portions 15 of outer casing 14 together. The interliner also is secured to side portions 15, via stitching 16, in a manner conventional to those of ordinary skill. Although ears 24 are shown below the surface of elongated facing 20 that faces away from the interliner, they can be folded on and secured to the opposite surface of elongated facing 20. It should also be understood that although a double layer interliner is shown, a single layer interliner can be used. Such interliners typically comprise a warp and filling that are interwoven in a way conventional to those skilled in the art. Further, the interliner can vary in length, i.e., it can extend to the end of the wide end of the tie or it can extend to the vicinity of the juncture between bottom portion 21 and elongated portion 23. However, when the interliner is coextensive with facing 20, facing 20 can be provided with a slit to permit one end of the interliner to pass therethrough and behind bottom portion 21 of facing 20. Such a slit is illustrated in FIG. 2 by dashed line 29.

When the necktie is tied, there is formed in outer casing 14 immediately below knot 17 a dimple 18 located substantially between the marginal edges of the wide front portion of the necktie. The consistent formation of a dimple in the necktie when tied, will result from the firmness added along the longitudinal margins of the tie by folded ears 24. In other words, the thicker portion of the tie in the vicinity of ears 24 causes the portion of the tie in the vicinity of valley 26 to pucker. This results from the relatively thin cross-section at valley 26. Further, due to the roundness of folded ear portions 27 the portions of the tie about dimple 18 assume a rounded convex contour which, together with the formation of the dimple, results in the neat desired appearance of the necktie. The suppleness of the facing material and thus the suppleness of ear portions 24 add to the quality of the "hand" of the tie.

The simple construction of necktie 10 involves minimal manufacturing steps. Outer casing 14 is positioned with its interior portion exposed. Elongated facing 20 which can be polyester, acetate, silk, nylon or rayon, is positioned over the central interior portion of the casing and bottom portion 21 of facing 20 is stitched to the outer casing along the perimeter of the wide end portion of casing 20. Laterally spaced ears 24, which extend from respective longitudinal marginal edges 25 of elongated portion 23 of facing 20, are folded back upon elongated facing 20 and secured thereto such that the ends of the ears distal to longitudinal marginal edges 25 remain spaced and form a valley therebetween. Ears 24 can be secured to elongated facing by, for example, stitching or adhesive that remains supple after curing. Alternatively, ears 24 can be folded back upon elongated facing 20 before bottom portion 21 of facing 20 is stitched to outer casing 14. Then, outer casing side portions 15 are folded toward each other and a single or double interliner is arranged where the side portions overlap. Then side portions 15 together with the interliner are stitched together in a way conventional to those skilled in the art.

Having described the invention in detail, it will be recognized that the foregoing is considered as illustrative only of the principles of the invention. Since numerous modifications and changes will readily occur to those skilled in the art, it is not desired to limit the invention to the exact construction, materials, assembly and so forth shown and described. Accordingly, all suitable modifications and equivalents may be resorted to the extent they fall within the scope of the invention and claims appended hereto.

What is claimed:

1. A tie comprising:

an outer casing having a first end, a second end and an intermediate knot forming portion;

a secondary fabric having longitudinal marginal edges and a central portion therebetween, said fabric further including laterally spaced ears that extend from said longitudinal margin edges and fold back toward said central portion, each ear including an end distal to a respective longitudinal marginal edge, said distal ends being spaced from one another, said fabric being fixed to the back of said outer casing such that said ears are in the vicinity of said knot forming portion;

whereby when a knot is placed in said knot forming portion, said ears cause a dimple to be formed in said outer casing immediately below the knot.

2. The tie of claim 1 wherein said distal ends of said ears are secured to said fabric.

3. The tie of claim 2 wherein the ends of said ears are secured to said fabric by stitching.

4. The tie of claim 2 wherein the ends of said ears are secured to said fabric with adhesive.

5. The tie of claim I wherein said ears and fabric comprise a homogeneous one-piece construction.

6. The tie of claim 1 wherein said ears have a width that tapers in the direction toward said knot forming portion.

7. The tie of claim 1 further including an interliner disposed between said outer casing and said ears.

8. The tie of claim 7 wherein said fabric has a surface facing away from said interliner, said distal ends of said ears being secured to said surface.

9. The tie of claim 7 wherein said fabric has a surface facing toward said interliner said distal ends of said ears being secured to said surface.

10. The tie of claim 1 wherein said fabric comprises material selected from the group consisting of polyester, acetate, silk, nylon and rayon.

11. The tie of claim 1 wherein said first end is substantially wider than said second end.

12. The tie of claim 1 wherein said secondary fabric comprises elongated facing.

13. A tie comprising:

an outer casing having a first end, a second end and an intermediate knot forming portion;

elongated facing having longitudinal marginal edges and a central portion therebetween, said facing further including laterally spaced ears that extend from said longitudinal marginal edges and fold back toward said central portion, each ear including an end distal to a respective longitudinal marginal edge, said distal ends being spaced from one another and secured to a portion of said facing in the vicinity of said central portion, said elongated facing being sewn to the back of said outer casing such that said ears extend into said knot forming portion; and an interliner comprising a warp and filling, said interliner being disposed between said outer casing and said elongated facing, whereby when a knot is placed in said knot forming portion, said ears cause a dimple to be formed in said outer casing immediately below the knot.

14. A method of making a tie comprising the steps of:

providing an outer casing having longitudinal side portions, a first end, a second end and an intermediate portion about midway between said ends;

forming an elongated piece of secondary fabric having laterally spaced ears that extend from the longitudinal marginal edges of said fabric;

folding the ears back upon said elongated piece of secondary fabric;

securing the ends of said ears that are distal to said longitudinal marginal edges to said fabric;

coupling one end of said elongated piece of secondary fabric to said first end of the outer casing;

extending the remainder of said elongated piece of secondary fabric along said outer casing such that said ears are in the vicinity of said intermediate portion of said casing; and attaching the longitudinal side portions of said casing to one another to enclose the secondary fabric therein.

15. The method of claim 14 wherein said securing step includes securing said distal ends of the ears to said secondary fabric such that said distal ends are spaced from one another by about ¼ inch.

16. The method of claim 14 wherein said secondary fabric is selected from facing material having a least 80 threads per inch in the warp and at least 50 threads per inch in the filling.

17. The method of claim 14 further including providing an interliner between said casing and said elongated piece of secondary fabric.

18. The method of claim 17 including stitching the interliner to the outer casing.

* * * * *